US006499196B1

(12) United States Patent
Mittersinker et al.

(10) Patent No.: US 6,499,196 B1
(45) Date of Patent: Dec. 31, 2002

(54) PEN CLIP

(75) Inventors: Gregor Mittersinker, Warwick, RI (US); Soojung Ham, Providence, RI (US); Brian Conaty, Wilmington, DE (US)

(73) Assignee: A.T.K. International, Inc., Lincoln, RI (US)

( * ) Notice: Subject to any disclaimer, the term of this patent is extended or adjusted under 35 U.S.C. 154(b) by 0 days.

(21) Appl. No.: 09/931,823

(22) Filed: Aug. 17, 2001

(51) Int. Cl.[7] ..... B43K 25/00

(52) U.S. Cl. ..... 24/11 R; 24/11 CC; 24/11 HC; 24/11 F; 24/11 M

(58) Field of Search ..... 24/11 R, 11 CC, 24/11 HC, 11 M, 11 F

(56) References Cited

U.S. PATENT DOCUMENTS

| | | | | | |
|---|---|---|---|---|---|
| 432,809 | A | | 7/1890 | Weaver | |
| 703,820 | A | * | 7/1902 | Prahar | 24/11 M |
| 854,378 | A | | 5/1907 | Ochoa | |
| 886,095 | A | * | 4/1908 | Valkenburg | 24/11 R |
| 1,061,820 | A | | 5/1913 | Colbert | |
| RE13,596 | E | * | 7/1913 | Valkenburg | 24/11 R |
| 1,078,001 | A | | 11/1913 | Schneeman | |
| 1,211,463 | A | | 1/1917 | Lovin | |
| 1,288,766 | A | * | 12/1918 | Upton | 24/11 CC |
| 1,717,001 | A | | 6/1929 | Benson | |
| D81,248 | S | | 5/1930 | Larsen | |
| D81,254 | S | | 5/1930 | Parker | |
| D84,944 | S | | 4/1931 | Larsen | |
| 1,847,898 | A | | 3/1932 | Prestinari | |
| 1,923,153 | A | | 8/1933 | Lang | |
| 1,926,852 | A | | 9/1933 | Hanle | |
| 2,060,406 | A | | 10/1936 | Tiede | |
| 2,189,715 | A | * | 2/1940 | Hoiseth | 24/11 CC |
| 2,418,218 | A | * | 4/1947 | Bauer et al. | 24/11 M |
| D151,307 | S | | 10/1948 | Weston | |
| 2,457,272 | A | * | 12/1948 | Pritchard, Jr. | 24/11 R |
| 2,468,699 | A | | 4/1949 | Woods | |
| 2,470,431 | A | | 5/1949 | Coyne | |
| 2,498,857 | A | * | 2/1950 | Kanner | 24/11 R |
| 2,501,439 | A | | 3/1950 | Dean | |
| 2,530,608 | A | | 11/1950 | Fraser | |
| D314,978 | S | | 2/1991 | Oka | |
| D321,009 | S | | 10/1991 | Yubisui | |
| D332,627 | S | | 1/1993 | Anavil et al. | |
| D353,620 | S | | 12/1994 | Da Baillon | |
| D358,609 | S | | 5/1995 | Ferguson | |
| 5,448,459 | A | * | 9/1995 | Rogers | 362/191 |
| D418,870 | S | | 1/2000 | Polidoro | |
| D418,873 | S | | 1/2000 | Shen | |
| D430,210 | S | | 8/2000 | Shimizu | |
| D430,606 | S | | 9/2000 | Veillon | |
| D438,249 | S | | 2/2001 | Hollington et al. | |

FOREIGN PATENT DOCUMENTS

| | | | | |
|---|---|---|---|---|
| DE | 2532204 | * | 2/1976 | 24/11 M |
| DE | 3903415 | * | 8/1990 | 24/11 CC |
| DE | 4208466 | * | 9/1993 | 24/11 HC |

* cited by examiner

*Primary Examiner*—Victor Sakran
(74) *Attorney, Agent, or Firm*—Notaro & Michalos P.C.

(57) ABSTRACT

A clip for a writing instrument has an external biasing mechanism separate from the connection of the clip to the writing instrument to avoid permanent deformation or breaking of the clip arm and wear on the writing instrument body. The biasing mechanism is a coil spring mounted on the clip arm between two supports for compression and flexion when the clip arm is pulled away from the side of the writing instrument.

24 Claims, 3 Drawing Sheets

PEN CLIP

FIELD AND BACKGROUND OF THE INVENTION

The present invention relates generally to the field of writing instruments and in particular to a new and useful pen clip having a bias spring held on the clip arm to provide a gripping force while reducing the likelihood of breaking due to wear.

Clips secured to the cap or barrel of a writing instrument for holding the writing instrument in a shirt pocket or on a pad of paper are generally known. Many prior clips are biased simply by a bent strip of metal, which form a U-shape, similar to a leaf spring. One end of the strip of metal is secured to a writing instrument barrel or cap. over time, flexion of the strip can lead to permanent deformation or the connecting strip breaking and the clip becoming irreparably detached from the writing instrument.

A pen clip of this type is illustrated by U.S. Pat. No. 1,923,153, in which the clip arm is made of a metal and has a small ball at the end to assist a person in putting the clip over the edge of a pocket. The clip relies upon the deformation of the clip arm so that the clip can be fit over a pocket edge.

U.S. Pat. No. 1,926,852 discloses a pen clip having a spring formed by a planar strip of metal connecting the clip arm to a pen cap. The spring is simply a resilient piece of metal secured to the pen cap at one end and having the clip arm mounted over the other end. The clip arm movement is limited by the upper end of the clip arm resting against the side of the cap and the surface of the spring.

Some prior pen clips include metal coils which are non-functional as springs and are used only to secure a clip to a writing instrument or other object.

U.S. Pat. No. 854,378, for example, has a pen clip formed from a single length of wire which is bent into a loop in the center to form a clip arm. The ends of the loop are wound together into a coil having the coil longitudinal axis parallel to the length of the clip arm. The coil is adapted to fit over varying diameter writing instruments, while the loop extends from one end of the coil to form a clip on the side of a writing instrument. The loop simply deforms away from the side of the pen or pencil that the coil has been fitted over. The coil is expected to tightly hold the clip to the pen and is not intended to deform or compress when the clip arm is pivoted away from the writing instrument.

U.S. Pat. No. 1,211,463 teaches a device holder having a coil holding a tube and gripping jaws formed by the ends of the coil which can be supported on a shirt pocket. The coil is not intended to compress or deform axially as the tube prevents that type of movement. The gripping jaws are biased closed by the coil and can hold objects.

Other clips have rigid clip arms with a perpendicular upper section connected to a writing instrument. The upper sections are used to pivotally w hold the clip to the writing instrument, such as in U.S. Pat. No. 2,468,699, which shows a pen clip mounted to a pen cap by a spring-biased fulcrum at the top of the pen cap. The clip arm may be pivoted away from the side of the pen cap, causing the upper end of the clip arm to move against a spring mounted perpendicular to the clip inside the writing instrument body.

A pen clip having the enclosed end inside the cap biased against a coil spring positioned vertically inside the cap is taught by U.S. Pat. No. 2,498,857. The clip arm extends out of the cap through a slot which permits the clip to pivot away from the side of the pen cap. The horizontal enclosed end of the cap is held between the upper end of the cap and the spring. The spring and clip enclosed end are mounted around a cylindrical threaded connector which also closes the end of the cap.

These types of clips suffer from the problem of complex manufacturing requirements to incorporate the spring mechanism inside the writing instrument. Further, the clip is not rigidly held to the writing instrument, but instead, has a flexible connection which is subject to breaking or wear which is not easily repairable. Since the upper end of the clip arm has to pass through the writing instrument body, the side of the writing instrument can be damaged, and the clip arm is still subject to breaking from excessive force applied to the bent portion.

SUMMARY OF THE INVENTION

It is an object of the present invention to provide a clip for a writing instrument which has a robust biasing mechanism external of the writing instrument body.

It is a further object of the invention to provide a clip using a coil spring to bias the clip arm.

Yet another object of the invention is to provide a clip biasing mechanism with a significantly reduced likelihood of breaking or permanently deforming.

A further object of the invention is to provide a clip for a writing instrument which is biased toward the writing instrument body and connected to the writing instrument body by two separate components.

Accordingly, a clip for a writing instrument has a clip arm with two ends, the upper end being threaded to receive a fastener, a spring fit over the upper end of the clip arm, and a flange adjacent the upper end having a diameter larger than the spring. A support arm having a hole therethrough extends perpendicularly from the writing instrument or a cap for the writing instrument near its top end. The threaded end of the clip arm is inserted through the hole from the bottom side so that the upper end of the spring rests against the bottom surface of the support arm. The fastener is secured to the upper end of the clip arm and holds the clip arm in the hold. The bottom edge of the fastener rests against the upper surface of the support arm. The spring is compressed slightly between the bottom surface of the support arm and the flange, so that in combination with the orientation of the support arm, the clip arm is biased toward the side of the writing instrument.

The clip can be connected to the cap or the body of a writing instrument. The clip can be used with pens, pencils, markers and non-marking stylii, among other types of writing instrument. The clip has a solid connection to the writing instrument with a separate, durable, flexible bias mechanism for holding the clip toward the writing instrument body. Although the bias spring is constricted partly by the support arm, they are separate components, so that using the bias mechanism does not require the support arm to flex or move.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
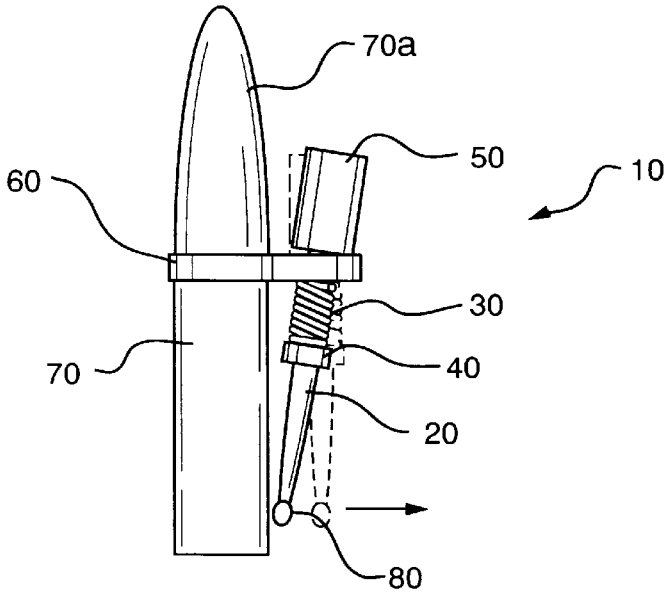
FIG. 1 is a side elevational view of a cap for a writing instrument having a clip according to the invention.

Referring now to the drawings, in which like reference numerals are used to refer to the same or similar elements, FIG. 1 shows a writing instrument body 70 having a clip 10 extending to one side. In the embodiment of FIG. 1, the writing instrument body 70 is a pen cap.

Figure 2:
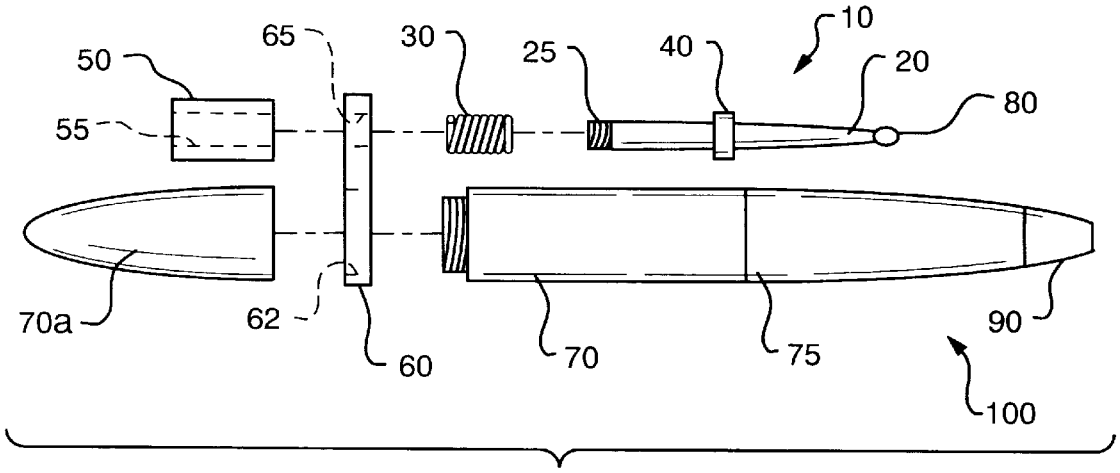
FIG. 2 is an exploded side elevational view of a writing instrument having the clip of FIG. 1.

As used herein, writing instrument is intended to broadly encompass those devices which having marking and/or non-marking tips used to write or draw, such as pencils, ball-point, gel ink and rolling ball pens, fountain pens, felt markers, highlighter pens and markers, and stylii, including PDA stylii, such as are used with touch-sensitive screens. The clip 10 can be secured to a writing instrument cap or to one end of the writing instrument body, as shown in FIG. 2.

Referring again to FIG. 1, the body 70 has an upper section 70*a* which is separable from the body 70. A support arm 60 is secured between body 70 and upper section 70*a* as will be described more fully below. The support arm 60 extends rigidly generally perpendicular to one side of the body 70. The support arm 60 receives and holds a clip arm 20 adjacent the body 70 oriented generally parallel to the side of the body 70. The clip arm 20 is preferably arranged so that the clip end 80 is positioned touching or nearly touching the body 70.

A biasing mechanism is formed by coil spring 30 fit over the upper end of clip arm 20 and held between the lower surface of the support arm 60 and a flange 40 on the clip arm. A fastener 50 secures the clip arm 20 on the support arm 60 and fixes the compression of the coil spring 30. The diameter of the flange 40 and outer diameter of the support arm 60 are both larger than the diameter of the coil spring 30, so that the ends of the coil spring 30 are prevented from slipping over either of them and the coil spring subsequently falling off the clip arm 20.

The coil spring 30 is placed at least slightly under compression, so that the clip arm 20 can be pivotally moved from the stationary resting position under force to a use position (shown in phantom in FIG. 1), but the coil spring 30 returns the clip arm 20 to its original resting position adjacent the writing instrument body 70 when the force is removed. The clip 10 can thus be used to secure the writing instrument body 70 to an object, such as over the edge of a shirt pocket or a note pad or other similar, planar objects.

FIG. 2 illustrates the clip 10 connected to the top end of a writing instrument body 70 that is part of a pen 100. The pen 100 has upper end 70*a*, upper writing instrument body 70, lower body 75 and pen point 90. Pen 100 may be of a type in which the upper writing instrument and lower bodies 70, 75 are twisted relative to each other to cause a writing tip to extend through the pen point 90 for use. The upper end 70*a* of the pen is adapted to receive a reduced diameter threaded connection 72 on upper writing instrument body 70 after the threaded connection 72 is inserted through body opening 62 in the support arm 60. The support arm 60 is captured between the upper end 70*a* and upper writing instrument body 70.

In an alternative embodiment, a male threaded section may be formed on upper end 70*a* which is inserted through body opening 62 and secured to a corresponding female fastener in the upper writing instrument body 70. The support arm 60 is again captured between the upper end 70*a* and writing instrument body 70.

As shown in FIG. 2, the clip arm 20 supports coil spring 30 between flange 40 and the lower surface of support arm 60. The threaded upper end 25 of clip arm 20 is inserted through a hole 65 in the support arm. Tubular fastener 50 having a corresponding thread in channel 55 is secured to the threaded upper end 25 of the clip arm 20. The outside diameter of tubular fastener 50 is larger than that of the hole 65, so that fastener 50 may be tightened to compress coil spring slightly between the flange 40 and support arm 60 without passing through the hole 65. The flange 40 provides a stepped upper surface for supporting the bottom end of the coil spring 30.

Figure 3:
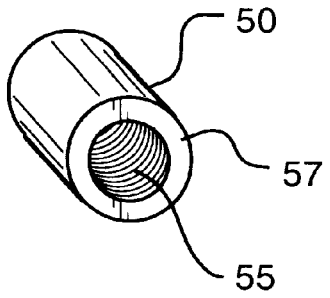
FIG. 3 is a perspective view of a fastener used with the clip of FIG. 1.
Figure 4:
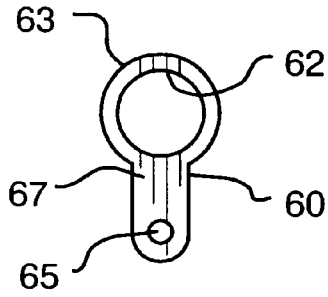
FIG. 4 is a top plan view of a clip support used with the clip of FIG. 1.
Figure 5:
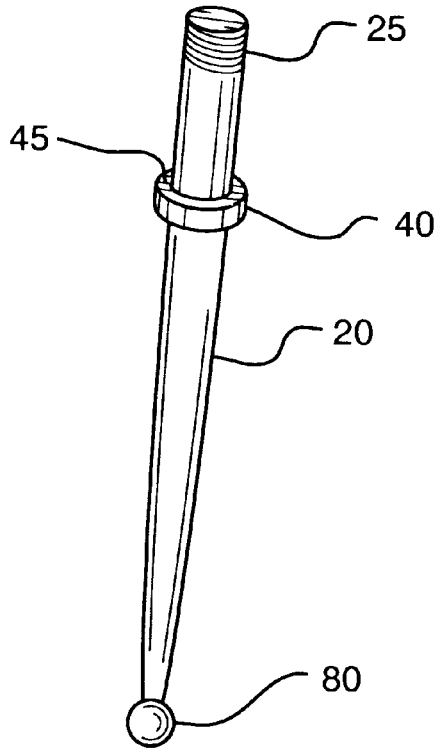
FIG. 5 is a perspective view of the clip arm of the clip of FIG. 1.

FIGS. 3–5 display the fastener 50, support arm 60, and clip arm 20, respectively, so that the features of each part are more clearly seen. In FIG. 3, the fastener 50 has channel 55 with threads 57 for securing to the clip arm 20.

FIG. 4 shows one embodiment of the positions of the body opening 62 and hole 65. As seen, the hole 65 is located at the end of a neck 67 extending from an annular portion 63 created by body opening 62. The annular portion 63 is the portion of the support arm 60 which is held rigidly between the upper end 70*a* and writing instrument body 70. The neck 67 is sized to provide a rigid support to the clip arm 20 connected through hole 65 and prevent the neck 67 or other parts of the support arm 60 from deforming when the clip arm 20 is pivotally moved in use. It should be noted that the support arm 60 could be formed integral with the writing instrument body 70, eliminating the need for upper end 70*a*. In such case, a neck 67 having a hole 65 would extend from one side of the writing instrument body 70.

The clip arm 20 in FIG. 5 has flange 40 with upper surface 45 for supporting the lower end of the coil spring 30. A ball 80 or other element is located at the end of the clip arm 20 forming the opening of the clip 10. The ball 80 is helpful in passing the clip 10 over a shirt pocket or the edge of a paper pad when the clip 10 is used.

That the support arm 60 is a separate, rigid piece distinct from the clip arm 20 and coil spring 30, is a feature of the invention which provides the benefit of a significantly reduced chance of breaking or permanently deforming the biasing mechanism for the clip 10. Although the clip arm 20, coil spring 30 and fastener 50 form a pivot connection through hole 65, they move independently of the support arm 60 and do not cause the support arm 60 to deflect, deform or otherwise move.

The support arm 60 and other components may each be made of materials which can withstand frictional contact caused by the pivoting movement without significant deterioration or wear. Some erosion due to contact between components is expected, but this is considered preferable to having the clip arm break off from the writing instrument as a result of the spring wearing out as is common with known pen clips. While metals are preferred materials for the several components, as metals will provide the best wear between components, it is envisioned that plastics and other polymers could be used to make the clip 10 as well without significant detriment to achieving the objects of the invention. Alternatively, protective coatings could be used to reduce frictional wear between components.

Figure 6:
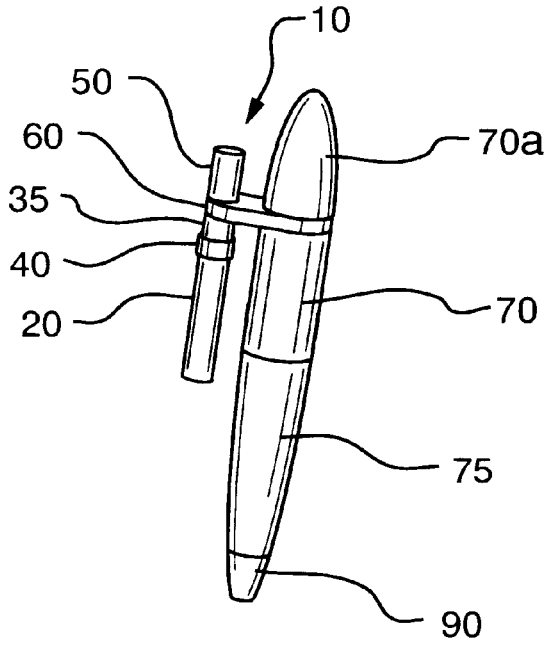
FIG. 6 is a perspective view of an alternate embodiment of the clip of FIG. 1.

FIG. 6 shows an alternative embodiment of the clip 10 in which a sheath or cover 35 is fitted over the coil spring between the support arm and flange 40 on the clip arm 20. When the cover 35 is rigid, it is made sufficiently loose to permit pivoting of the clip arm 60. Since the preferred size of the clip is not large, the amount of movement which must be accommodated is relatively small. Alternatively, the cover 35 can be a flexible material, such as fabric, rubber, or plastic mesh, among others, which covers the entire space between the support arm 60 and flange 40, but bends when the clip arm 20 is moved to a use position. The flange 40 should be sized to have a diameter so that the coil spring 30 and cover 35 are both supported and prevented from falling off the clip arm 20.

Figure 7:
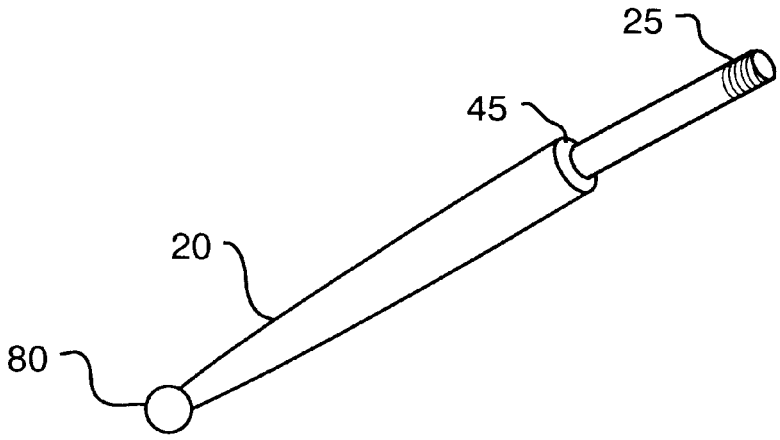
FIG. 7 is a perspective view of an alternate clip arm for use with the clip of FIG. 1.

An alternative clip arm 20 is displayed in FIG. 7, in which the flange does not extend past the surface of the lower section of the clip arm 20. Only a stepped upper flange surface 45 is formed to provide support for the coil spring 30 and cover 35 when it is used.

Preferably, the outer diameters of the flange 40, support arm 60 around hole 65, spring coil 30 and fastener 50 are the same, so that the clip 10 has the appearance of a continuous outer surface. When the cover 35 is used, the outer diameter of the coil spring 30 is reduced appropriately to permit the cover 35 to conform to the outer diameters of the other components instead.

While a specific embodiment of the invention has been shown and described in detail to illustrate the application of the principles of the invention, it will be understood that the invention may be embodied otherwise without departing from such principles.

What is claimed is:

1. A clip for a writing instrument comprising:

a clip support rigidly extending from the writing instrument and defining a hole at a free end of the clip support;

a clip arm, an upper end of the clip arm passing through the hole of the clip support;

fastening means for securing the clip arm to the clip support through the hole;

biasing means held on the clip arm for biasing the clip arm toward a resting position adjacent the writing instrument, the biasing means being distinct from the clip support and external to the writing instrument, the clip arm having a use position spaced from the writing instrument for clipping the writing instrument to an object against the bias of said biasing means.

2. A clip according to claim 1, wherein the clip arm has a stepped portion.

3. A clip according to claim 2, wherein the biasing means comprises a coil spring supported around the clip arm between a lower surface of the clip support and the stepped portion, the coil spring being under compression.

4. A clip according to claim 3, wherein the fastening means comprises a threaded end on the clip arm extending above the hole and a fastener having a corresponding thread secured to the threaded end of the clip.

5. A clip according to claim 4, further comprising a sheath surrounding the coil spring, the sheath permitting pivotal movement of the clip arm.

6. A clip according to claim 5, wherein the stepped portion is a flange.

7. A clip according to claim 1, wherein the fastening means comprises a threaded end on the clip arm extending above the hole and a fastener having a corresponding thread secured to the threaded end of the clip.

8. A clip for a writing instrument comprising:

a clip support rigidly extending from an end of the writing instrument, the clip support having a free end defining an opening therethrough;

a clip arm having a threaded upper end and a stepped portion spaced apart from the threaded upper end, the clip arm held in the opening having the threaded upper end located on a top side of the clip support opening and the stepped portion located on a bottom side of the clip support opening;

a coil spring fitted around the clip arm, a coil spring lower end resting against the stepped portion, a coil spring upper end resting against a bottom surface of the clip support;

a fastener secured to the threaded end for pivotally holding the clip arm in the clip support opening, wherein the clip arm may be pivoted from a resting position under a force and the coil spring biases the clip arm toward the resting position.

9. A clip according to claim 8, wherein the stepped portion comprises a flange.

10. A clip according to claim 8, further comprising a cover surrounding the coil spring, the cover permitting pivotal movement of the clip arm.

11. A clip according to claim 10, wherein the cover is a flexible sheath.

12. A clip for a writing instrument comprising:

a clip support rigidly extending from the writing instrument and defining a hole at a free end of the clip support;

a clip arm, an upper end of the clip arm passing through the hole of the clip support;

fastening means for retaining the clip arm in the hole of the clip support; and biasing means mounted on the clip arm for biasing the clip arm toward a resting position adjacent the writing instrument by compression or flexion in a direction generally corresponding to a longitudinal axis of the clip arm, the biasing means being distinct from the clip support and external to the writing instrument, the clip arm having a use position spaced from the writing instrument for clipping the writing instrument to an object against the bias of said biasing means.

13. A clip according to claim 12, wherein the clip arm has a stepped portion.

14. A clip according to claim 13, wherein the biasing means comprises a coil spring supported around the clip arm between a lower surface of the clip support and the stepped portion, the coil spring being under compression.

15. A clip according to claim 14, wherein the fastening means comprises a threaded end on the clip arm extending above the hole and a fastener having a corresponding thread secured to the threaded end of the clip.

16. A clip according to claim 15, further comprising a sheath surrounding the coil spring, the sheath permitting pivotal movement of the clip arm.

17. A clip according to claim 16, wherein the stepped portion is a flange.

18. A clip according to claim 12, wherein the fastening means comprises a threaded end on the clip arm extending above the hole and a fastener having a corresponding thread secured to the threaded end of the clip.

19. A clip according to claim 12, further comprising a sheath surrounding the biasing means, the sheath permitting pivotal movement of the clip arm.

20. A clip for holding a writing instrument to an object, the clip comprising:

an elongated clip arm extending alongside the writing instrument in a longitudinal direction;

support means for pivotally connecting the clip arm to the writing instrument in spaced relation adjacent the writing instrument; and biasing means mounted on the clip arm for biasing the clip arm toward a resting position adjacent the writing instrument by compression or flexion in the longitudinal direction, the biasing means being distinct from the support means and external to the writing instrument, the clip arm having a pivoted use position spaced from the writing instrument for clipping the writing instrument to an object against the bias of said biasing means.

21. A clip according to claim 20, wherein the support means comprises a support arm extending rigidly from the writing instrument and fastening means for securing the clip arm to the support arm.

22. A clip according to claim 21, wherein the biasing means comprises a coil spring around the clip arm between the support arm and a stepped portion on the clip arm, the coil spring being under compression.

23. A clip according to claim 22, further comprising a sheath surrounding the coil spring.

24. A clip according to claim 20, further comprising a sheath surrounding the biasing means.

* * * * *

UNITED STATES PATENT AND TRADEMARK OFFICE

CERTIFICATE OF CORRECTION

PATENT NO. : 6,499,196 B1
DATED : December 31, 2002
INVENTOR(S) : G. Mittersinker et al.

It is certified that error appears in the above-identified patent and that said Letters Patent is hereby corrected as shown below:

Title page,
Item [73], Assignee, please change the name of the Assignee from "A.T.K. International, Inc" to -- A.T.X. International, Inc. --.

Signed and Sealed this

First Day of July, 2003

JAMES E. ROGAN
*Director of the United States Patent and Trademark Office*